United States Patent [19]

Fox et al.

[11] Patent Number: 5,014,621

[45] Date of Patent: May 14, 1991

[54] OPTICAL TARGET DETECTOR

[75] Inventors: Thomas M. Fox, Gilbert; Neal R. Anderson, Mesa, both of Ariz.

[73] Assignee: Motorola, Inc., Schaumburg, Ill.

[21] Appl. No.: 516,404

[22] Filed: Apr. 30, 1990

[51] Int. Cl.[5] ..... F42C 13/02; F41G 7/26

[52] U.S. Cl. ..... 102/213; 244/3.16

[58] Field of Search ..... 102/213; 244/3.16

[56] References Cited

U.S. PATENT DOCUMENTS 4,518,255 5/1985 Zuleeg ..... 356/5

4,903,602 2/1990 Skagerlund ..... 102/213

*Primary Examiner*—Charles T. Jordan

*Attorney, Agent, or Firm*—Frank J. Bogacz

[57] ABSTRACT

An optical target detector utilizes a star coupler to achieve automatic alignment of "pencil" laser beams. A number of "pencil" beams of laser light are deployed from the surface of a projectile in order to detect a target. The laser light is transmitted to the target and reflected back from the target to the optical target detector. The light tramsmitted, in the form of a number of "pencil" beams, and the light being reflected by the target are transmitted through a star coupler device in order to maintain alignment for the transmission of maximum light signal strength and simultaneously to minimize aerosol backscatter.

14 Claims, 1 Drawing Sheet

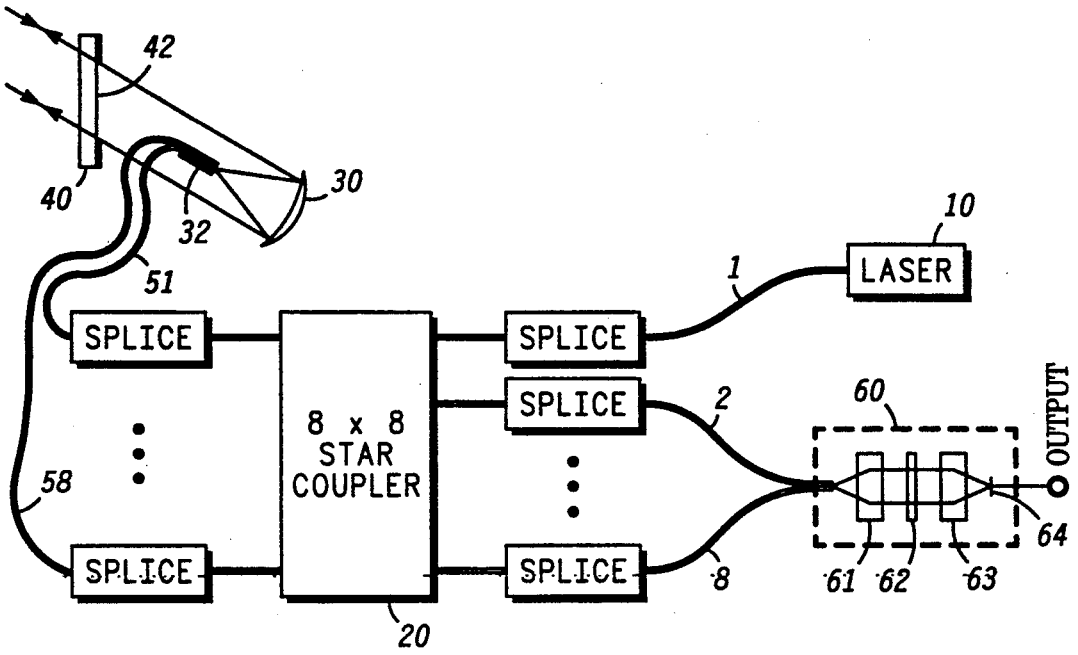
FIG. 1
FIG. 2A
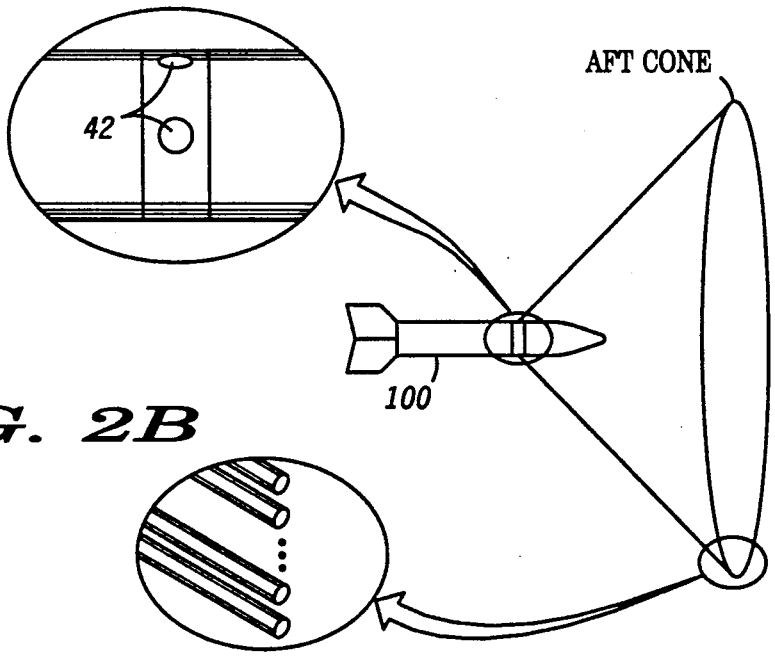
FIG. 2B

OPTICAL TARGET DETECTOR

STATEMENT OF GOVERNMENT INTEREST

This invention was made with Government support under Contract No F08635-85-C-0264. The Government has certain rights in this invention.

BACKGROUND OF THE INVENTION

The present invention pertains to optical target detection and more particularly to alignment of relatively small transmit and receive fuze light beams.

Present day optical fuze systems rely on mechanical alignment of separate transmit and receive fuze light beams for target detection. Since in separate aperture optical systems both fields of view are not coincident, alignment between receiver and transmitter beams over all operating regions is critical. One such system which requires mechanical alignment of optical fibers is shown in U.S. Pat. No. 4,518,255, issued on May 21, 1985 to Ranier Zuleeg and having McDonnell Douglas Corporation as the assignee.

Relatively small beams require tight tolerances in the alignment process. Also, aerosol backscatter performance degradation is directly related to the size of the fuze beams. Smaller fuze beams illuminate less aerosol and produce less aerosol backscatter. If the fuze light beams are enlarged to provide for easier alignment tolerances, an unsatisfactory fuze beam size for adequate aerosol rejection is the result.

Accordingly, it is an object of the present invention to provide an optical target detector providing for accurate alignment of receive and transmit beams while providing a high level of aerosol backscatter rejection.

SUMMARY OF THE INVENTION

In accomplishing the above-mentioned object of the present invention, a novel optical target detector having accurate alignment of receive and transmit light beams is shown.

An optical target detector system provides an output which has low noise in response to detection of a target. The optical target detector system includes a source of laser light for transmitting a pulsed laser light beam. The optical target detector system also includes a star coupler which has a plurality of inputs and outputs for accurately aligning and distributing "pencil" light beams between the inputs and the outputs.

A first fiber optic is connected between the laser light source and the star coupler. The first fiber optic transmits the pulsed "pencil" light beams to the star coupler. A receiver/transmitter transmits the pulsed "pencil" light beams of the laser light source. In addition, the receiver/transmitter receives returned pulsed light beams from the target.

Second fiber optics connects the receiver/transmitter and the star coupler. The second fiber optics provide for transmitting the pulsed light beams to the receiver/-transmitter and for transmitting the returned pulsed light beams from the receiver/transmitter to the star coupler.

A detector receives the returned pulsed light beams. The detector provides an electrical output in response to the receipt of the returned pulsed light beams. A third fiber optic connects the star coupler to the detector. The third fiber optic transmits the returned pulsed light beams to the detector for analysis of target detection.

The above and other objects, features, and advantages of the present invention will be better understood from the following detailed description taken in conjunction with the accompanying drawings.

BRIEF DESCRIPTION OF THE DRAWINGS

FIG. 1 is a block diagram of an optical target detector with accurately aligned receive and transmit beams.

FIG. 2 is a diagram of a missile in flight projecting target beam cones utilizing the present invention.

DETAILED DESCRIPTION OF THE PREFERRED EMBODIMENT

Referring to FIG. 1, a block diagram of the optical target detector of the present invention is shown. A source of laser light 10 is connected via a splice by optical fiber 1 to star coupler 20. Star coupler 20 is connected via splices by optical fibers 2 through 8 to the filter/detector 60. Filter/detector 60 includes a collimating lens 61 which receives the light output of fibers 2 through 8. Next, filter/detector includes a bandpass filter 62 and a focusing lens 63. The light emerging from the focusing lens is focused on detector 64..

Star coupler 20 is also connected to optical fibers 51 through 58 via splices. Optical fibers 51 through 58 are positioned so that the light emitted from these fibers impinges on spherical mirror 30. However, only fibers 51 and 58 are shown because of the difficulty in drawing each of the other fibers. Each of the fibers is held in place within the curvature of spherical mirror 30 by fiber holder 32. Fibers 51 through 58 are held in place by fiber holder 32 within the curve of spherical mirror 30 such that the light rays of fibers 51 through 58 are reflected from spherical mirror 30 through aperture 42 of window 40. In addition, light returning may enter aperture 42 of window 40 and be reflected from spherical mirror 30 into fibers 51 through 58.

Laser 10 provides the light required for the "pencil" beams of the optical target detector system. The output of laser 10 is pulsed. These pulses are transmitted via optical fiber 1 to 8 × 8 star coupler 20. An 8 input by 8 output star coupler was chosen for this application, however, other sized star couplers may be selected. For example, a 4 input by 4 output or a 16 input by 16 output or N input by N output star coupler may be utilized.

The internal construction of star coupler 20 may be thought of as a group of optical fibers melted together in a homogeneous mass. Light input to the star coupler by optical fiber 1, for example, is equally distributed to the output optical fibers 51 through 58. The power of the light is also equally distributed among the output optical fibers less the insertion loss of the star coupler which has power typically dissipated as heat. Hence, the light input from laser 10 via optical fiber 1 is transmitted by star coupler 20 equally out via optical fibers 51 through 58. Since optical fibers 51 through 58 are positioned at the focus of spherical mirror 30, the light emitted from optical fibers 51 through 58 impinges upon a spherical mirror and is reflected through the aperture 42 of window 40 as "pencil" beams.

If the light beams which are emitted from the aperture 42 of the target detector system impinge upon an object (target), these light beams are reflected back through aperture 42 of window 40. The light is then reflected from spherical mirror 30 and enters optical fibers 51 through 58. Optical fibers 51 through 58 transmit the light to star coupler 20. Star coupler 20 evenly distributes the light to optical fibers 1 through 8. The light output of optical fibers 2 through 8 is input to filter/detector 60. The light emitted from optical fibers 2 through 8 impinges upon collimating lens 61. Collimating lens 61 creates columns of light which are transmitted to bandpass filter 62. Bandpass filter 62 removes light wavelengths which are not emitted by the laser. Bandpass filter 62 limits the light from noise sources. Bandpass filter 62 then transmits the appropriate frequencies of light to focusing lens 63. Focusing lens 63 focuses the light impinging upon it to the detector 64. Detector 64 converts the optical energy to electrical energy and provides current on the output lead.

Detector 64 may be a semiconductor detector which outputs electrical current in response to photons or may be an avalanche-type semiconductor which outputs a larger current in response to photons.

Since some leakage light is transmitted from optical fiber 1 to fibers 2 through 8, some time multiplexing must be done to prevent interference. The laser light input to star coupler from laser 10 is pulsed. Therefore, the light returned from a target or object through star coupler 20 is produced on the output lead at the times when the laser 10 is in the OFF condition. Therefore, the output lead must be sampled at times when the output of laser 10 is in the OFF condition. A blanking switch (not shown) may be connected to the output lead and eliminates the signal when the output of laser 10 is in the ON condition. As a result, only the true signal reflected from an object or target will be provided to the system processor for further analysis.

As can be seen, since a star coupler was employed, the input and output (or receive and transmit) fibers are the same, eliminating the need for mechanical alignment. The star coupler serves to disperse any input light equally to the outputs. Therefore, as mentioned above, the object of this invention which is to provide highly accurate alignment of the receive and transmit beams is achieved by use of the star coupler device. Further, this system is particularly adaptable to eliminate aerosol backscatter. The star coupler may be implemented utilizing star couplers produced by the Amphenol Company or the Canstar Company.

Referring to FIG. 2, an airborne projectile 100 is shown. Projectile 100 is fitted with a number of apertures about the circumference of the projectile 100. Each of these apertures 42 transmits and receives beams of laser light in accordance with the present invention. Since these beams are projected from the entire circumference of projectile 100 as shown in FIG. 2, a cone of laser light is formed. By adding additional star couplers, lasers and detectors, multiple cone beams can be formed using the same spherical mirror and window. By projecting several cones, the projectile 100 may more accurately detect the presence of a target or object and thereby trigger the fuzing operation of the projectile.

Although the preferred embodiment of the invention has been illustrated, and that form described in detail, it will be readily apparent to those skilled in the art that various modifications may be made therein without departing from the spirit of the invention or from the scope of the appended claims.

What is claimed is:

1. An optical target detector system for providing an output signal in response to detection of a target, said optical target detector system comprising:

laser light means for transmitting pulsed light beams;

star coupler means having a plurality of inputs and a plurality of outputs for automatically aligning light beams between said inputs and said outputs;

first fiber optic means connected between said laser light means and said star coupler means, said first fiber optic means transmitting said pulsed light beams to said star coupler means;

means for transmitting said pulsed light beams and for receiving returned pulsed light beams from a target;

second fiber optic means connected between said means for transmitting and for receiving and said star coupler means, said second fiber optic means for transmitting said pulsed light beams and for receiving said returned pulsed light beams;

detection means for receiving said returned pulsed light beams and providing said output signal in response to said returned pulsed light beams; and third fiber optic means connected between said star coupler means and said detection means, said third fiber optic means for transmitting said returned pulsed light beams to said detection means.

2. An optical target detector system as claimed in claim 1, wherein said means for receiving and for transmitting includes spherical mirror means having a surface for reflecting said pulsed light beams and for reflecting said returned pulsed light beams.

3. An optical target detector system as claimed in claim 2, wherein said means for receiving and for transmitting further includes a window including an aperture through which said reflected pulsed light beams are transmitted from said optical target detector system toward said target and through which said returned pulsed light beams are reflected from said target through said aperture of said window to said second fiber optic means.

4. An optical target detector system as claimed in claim 3, wherein said second fiber optic means includes a plurality of fiber optic means, each connected to said star coupler means and said plurality of fiber optic means each having an end fixed, so that the light emitted from each end of said plurality of said fiber optic means is transmitted onto said spherical mirror means.

5. An optical target detector system as claimed in claim 4, wherein there is further included fiber optic holding means for fixing each of said ends of said plurality of second fiber optic means in a fixed position with respect to said reflecting surface of said spherical mirror means.

6. An optical target detector system as claimed in claim 5, wherein said detection means includes:

first lens means for collimating said returned pulsed light beams;

second lens means for passing only certain frequency of said collimated light beams, said second lens means positioned so that said collimated light beams of aid first lens means impinge upon said second lens means; and third lens means for focusing said passed frequency light beams to a focus point, said third lens means positioned so that said passed frequency light beams of said second lens means impinge upon said third lens means.

7. An optical target detector system as claimed in claim 6, wherein said detection means includes light detector means positioned at said focus point of said third lens means to detect said focused, pulsed light beams and said light detector further operating to produce an electrical output in response to said detected light beams.

8. An optical target detector system as claimed in claim 7, wherein said third fiber optic means includes a plurality of fiber optic means each connected to said star coupler means and each having an end, said end being fixed relative to said first lens means, so that said returned pulsed light beams impinge upon said first lens means.

9. An optical target detector system as claimed in claim 8, wherein:

said connection of said first fiber optic means to said star coupler means includes an optical splice;

said connection of said plurality of second fiber optic means to said star coupler means each includes an optical splice; and said connection of each of said plurality of third fiber optic means to said star coupler means each includes an optical splice.

10. An optical target detector system as claimed in claim 9, wherein said light detector means includes semiconductor detector means.

11. An optical target detector system as claimed in claim 10, wherein said light detector means includes avalanche semiconductor detector means.

12. An optical target detector system as claimed in claim 11, wherein said pulsed light beams of said laser light means include "pencil" light beams.

13. In a projectile, an optical target detector system for providing an output signal in response to detection of a target, said projectile comprising:

a substantially cylindrical body;

a plurality of optical target detectors located about a circumference of said body of said projectile; and each of said plurality of target detectors including:

laser light means for transmitting pulsed light beams;

star coupler means having a plurality of inputs and a plurality of outputs for automatically aligning light beams between said inputs and said outputs;

first fiber optic means connected between said laser light means and said star coupler means, said first fiber optic means transmitting said pulsed light beams to said star coupler means;

means for transmitting said pulsed light beams and for receiving returned pulsed light beams from a target;

second fiber optic means connected between said means for transmitting and for receiving and said star coupler means, said second fiber optic means for transmitting said pulsed light beams and for receiving said returned pulsed light beams;

detection means for receiving said returned pulsed light beams and providing said output signal in response to said returned pulsed light beams; and third fiber optic means connected between said star coupler means and said detection means, said third fiber optic means for transmitting said returned pulsed light beams to said detection means.

14. In a projectile, an optical target detector system for providing an output signal in response to detection of a target, said projectile comprising:

a substantially cylindrical body;

a plurality of optical target detectors, each target detector transmitting and receiving through a common aperture and common reflective device; and each of said plurality of target detectors including:

laser light means for transmitting pulsed light beams;

star coupler means having a plurality of inputs and a plurality of outputs for automatically aligning light beams between said inputs and said outputs;

first fiber optic means connected between said laser light means and said star coupler means, said first fiber optic means transmitting said pulsed light beams to said star coupler means;

means for transmitting said pulsed light beams and for receiving returned pulsed light beams from a target;

second fiber optic means connected between said means for transmitting and for receiving and said star coupler means, said second fiber optic means for transmitting said pulsed light beams and for receiving said returned pulsed light beams;

detection means for receiving said returned pulsed light beams and providing said output signal in response to said returned pulsed light beams; and third fiber optic means connected between said star coupler means and said detection means, said third fiber optic means for transmitting said returned pulsed light beams to said detection means.

* * * * *